US006909841B2

(12) United States Patent
Linow et al.

(10) Patent No.: US 6,909,841 B2
(45) Date of Patent: Jun. 21, 2005

(54) INFRARED EMITTER ELEMENT WITH COOLING TUBE COVERED BY REFLECTOR

(75) Inventors: Sven Linow, Hanau (DE); Stefan Fuchs, Niedernberg (DE); Petra Zellmann, Biebergemünd (DE)

(73) Assignee: Heraeus Noblelight GmbH, Hanau (DE)

( * ) Notice: Subject to any disclaimer, the term of this patent is extended or adjusted under 35 U.S.C. 154(b) by 0 days.

(21) Appl. No.: 10/792,040

(22) Filed: Mar. 3, 2004

(65) Prior Publication Data

US 2004/0175162 A1 Sep. 9, 2004

(30) Foreign Application Priority Data

Mar. 4, 2003 (DE) ..... 103 09 560
Oct. 4, 2003 (DE) ..... 103 46 094

(51) Int. Cl.[7] ..... H01K 1/28; H05B 3/00

(52) U.S. Cl. ..... 392/407; 392/424; 250/504 R; 313/113

(58) Field of Search ..... 392/422–424, 392/407–408; 250/504 R, 493.1; 313/113; 362/345, 341; 219/553

(56) References Cited

U.S. PATENT DOCUMENTS 4,071,798 A * 1/1978 Hammond ..... 313/18
5,054,107 A 10/1991 Batchelder
5,382,805 A * 1/1995 Fannon et al. ..... 250/504 R
6,713,945 B2 * 3/2004 Fuchs et al. ..... 313/113

FOREIGN PATENT DOCUMENTS

DE 100 41 564 A1 3/2002
GB 1531406 * 11/1978
WO WO 98/31045 A2 7/1998

* cited by examiner

*Primary Examiner*—John A. Jeffery
(74) *Attorney, Agent, or Firm*—Akin Gump Strauss Hauer & Feld, L.L.P.

(57) ABSTRACT

An infrared emitter element includes: at last one emitter tube made of silica glass, which has two ends; at least one electrical conductor arranged in the emitter tube as a radiation source; a cooling tube made of silica glass, which surrounds the at least one emitter tube spaced therefrom and which is connected to the at least one emitter tube directly at its ends, such that in the region of the electrical conductor at least one flow-supporting channel is formed between the at least one emitter tube and the cooling tube; and a metallic reflector. The cooling tube is completely covered with the reflector on its side facing away from the emitter tube. The infrared emitter element may be used as a flow-through heater, such as a heat exchanger, especially for high-purity fluids.

16 Claims, 7 Drawing Sheets

INFRARED EMITTER ELEMENT WITH COOLING TUBE COVERED BY REFLECTOR

BACKGROUND OF THE INVENTION

The invention is directed to an infrared emitter element having:

- at least one emitter tube made of silica glass, which has two ends,
- at least one electrical conductor arranged in the emitter tube as a radiation source,
- a cooling tube made of silica glass, which surrounds the at least one emitter tube spaced therefrom and which is connected to the at least one emitter tube at its ends, so that in the region of the electrical conductor, at least one flow-supporting channel is formed between the at least one emitter tube and the cooling tube, and
- a metallic reflector.

The invention is further directed to the use of such an infrared emitter element.

Infrared emitter elements mentioned above are known, for example, from German published patent application DE 100 41 564 A1. This publication discloses a cooled infrared (IR) emitter element, wherein FIGS. 5*a* to 6*c* show IR emitters sheathed by a silica-glass cooling tube and contacted on two ends. A coolant for cooling the IR emitters is provided for flow through the space between the cooling tube and the IR emitters. In the cooling tube, a reflector is located adjacent to the areas of the IR emitters that emit radiation, through which reflector a portion of the coolant can flow, without the IR radiation affecting this portion of the coolant. The IR radiation, which is emitted by the IR emitters, is led either directly through the radiation-permeable coolant and the silica-glass cooling tube or is first reflected by the reflector and then intersects the path through the cooling tube before it strikes the body to be treated.

International patent application publication WO 98/31045 discloses a heater for ultra-pure, de-ionized water with a cylindrical heating element, which is arranged between two tubes made of quartz glass. Inside and outside of this heating arrangement is a further respective tube made of quartz glass, whereby a first and a second annular flow channel is formed for the water to be heated. At the ends of the tubes, the tubes are connected by end caps made of plastic. The water flows from the first flow channel into the second, so that it flows once inside of and once outside along the cylindrical heating element. The heating of the water thereby results through heat conduction, convection, and radiation. A laminar flow is maintained in the flow channels in order to keep the erosion of the tubes by the water low. However, this also leads to the fact that the heat exchange is less effective. The arrangement is complicated, expensive, and difficult to seal due to the plurality of required components. The end caps, by which the four tubes made of quartz glass with different diameters are to be sealed, are formed of plastic and come in direct contact with the water to be heated. This is particularly disadvantageous because plastics can lead to contamination of the water with bacteria.

U.S. Pat. No. 5,054,107 describes a device for heating fluids by infrared radiation. Here, gas-flushed infrared emitters, consisting of a heat conductor in a jacket tube, are provided for heating ultra-pure water, which flows through a vessel made of quartz glass or PTFE. The vessel here can have a reflector, which reflects back into the water the radiation emitted by the infrared emitters and not absorbed directly by the water. A direct contact between the fluid to be heated and the jacket tube of the infrared emitter is not provided, so that the heating of the fluid must result only through radiation. In addition, cooling of the infrared emitter, the housing, and the reflector is required. The additional cooling of these components leads to heat losses and can represent a source for contamination of the ultra-pure fluid. Because the cooling efficiency for the cooling of the infrared emitter is poor, the output of this heat exchanger is limited. The preferred wavelength to be emitted by the infrared emitter is disclosed to be that of the maximum absorption of water at 3 $\mu$m. However, infrared radiation of this wavelength cannot penetrate far into the water and leads to non-uniform heating.

BRIEF SUMMARY OF THE INVENTION

Therefore, an object presented is to provide an infrared emitter element, which is adapted for efficient heating of liquids or gases with a simpler construction.

The object is achieved in that the cooling tube is completely covered with the reflector on its side facing away from the emitter tube. Such an arrangement of the reflector prevents discharge of radiation through the cooling tube. Instead, due to multiple reflections of the IR radiation not absorbed by the fluid at the reflector, a very long path length of the IR radiation in the fluid is achieved, whereby even radiation from wavelength ranges of lower absorption strengths is effectively absorbed by the fluid. This leads to a rapid heating of the fluid with high efficiency. Simultaneously, the emitter tube is cooled intensely by the direct contact with the fluid and protected from overheating. Consequently, the fluid is effectively heated not only by heat radiation, but also by heat conduction and convection.

It has been shown to be effective if the emitter tube is closed gas-tight on its two ends, wherein a gas-tight current bushing is arranged in at least one of the two ends for connection to the electrical conductor. Such a configuration is suitable particularly for short-wavelength radiation sources or radiation sources made of carbon material. If a medium-wavelength radiation source is used, then the emitter tube can even be open on its two ends.

To realize high outputs, it has been shown to be effective to use two electrical conductors in two adjacent emitter tubes, a so-called twin tube, in the cooling tube.

It has been shown to be especially effective if the cooling tube is arranged coaxial to the at least one emitter tube. Such an arrangement guarantees a uniform cooling of the emitter tubes on all sides and a uniform heating of a fluid fed through the cooling tube.

For cleaner supply and discharge of a fluid guided through the cooling tube, it is advantageous if the cooling tube has an inlet port on one of its ends and an outlet port on its other end.

In principle, the reflector can be made of a plurality of metals. Here, the use of gold as a reflector material has proven especially effective, according to which, among the corrosion-resistant metals, this has by far the highest degree of reflection in the near infrared. The reflector can be applied here directly on the cooling tube in the form of a coating or instead the reflector can surround the cooling tube as an independent tube. In terms of the efficiency and lifetime of the reflector, however, it is preferable to form the reflector as a coating. The deposition, for example, of a gold layer on the cooling tube, can be realized, among other things, through manual application with a paintbrush, a spray painter, or a transfer layer. In terms of the adhesion of the gold layer on the cooling tube and its durability, it has proven effective if the gold layer is fired onto the cooling tube.

Furthermore, the reflector can be covered on its side facing away from the cooling tube with a protective layer. It is especially sensible, when a gold layer is used as the reflector, to protect this layer from mechanical damage. Suitable for this purpose are, for example, scratch-resistant protective layers made of glass, aluminum oxide, or zirconium oxide. If the cooling tube is exposed to high pressure, then it can be advantageous to embed the tube in a highly crack-resistant plastic tube as the protective layer. Such protection prevents the risk of injury, in case of a rupture of the cooling tube.

To realize an optimum flow distribution in the cooling tube, it can be advantageous to arrange elements made of silica glass in at least one channel in order to influence the flow.

It has proven effective if the at least one channel has a circular ring-shaped (annular) or approximately circular ring-shaped cross section. Such a channel guarantees a substantially symmetrical heat distribution from the emitter tube to a fluid flowing through the cooling tube.

However, it is also advantageous if the at least one channel runs in a spiral along the at least one emitter tube. The dwell time of a fluid flowing through the cooling tube in the region of the at least one IR emitter can thereby be extended, and the achievable temperature of the fluid can be further increased.

As the material for the electrical conductor, tungsten or a carbon material has proven effective. Should high outputs be coupled, then it has proven effective to use the electrical conductor made of tungsten or a carbon material in an emitter tube closed on both ends and filled with inert gas or evacuated. In principle, however, any infrared emitter can be used. Thus, for example, electrical conductors can be used, which are formed from an alloy made of iron, aluminum, and chromium or from a nickel-chromium alloy. Such electrical conductors can be used without any additional means in an emitter tube that is open on both ends and thus exposed to air.

If water is the fluid to be heated in the cooling tube, it is preferable, in view of the infrared absorption behavior of water, to use short-wavelength emitters with a main portion of the radiation at wavelengths in the range of 1.3 to 1.8 $\mu$m. A good and uniform heating of the water is achieved at a layer thickness of a few millimeters, especially in this wavelength range (see FIG. 4). If thicker water layers are to be heated, then it has proven effective to use an emitter with a main portion of the radiation at wavelengths in the range of 0.9 to 1.4 $\mu$m (see FIG. 5). If a sufficiently turbulent flow is provided in the cooling tube, then longer wavelength radiation can be used instead to heat water.

Here, it has proven particularly effective if the electrical conductor arranged in the emitter tube is operated at temperatures in the range of about 2400° K to 2600°K. In addition to the good, homogeneous heating of the water in the cooling tube, a long lifetime for the infrared emitter element is also achieved thereby. In principle, however, the use of an electrical conductor with a higher temperature is desirable (see FIG. 5).

For other fluids or gases to be heated, the optimum emitter emissions should be determined separately.

A use of the infrared emitter element according to the invention as a through-flow heater for an especially high-purity liquid, particularly for high-purity or ultra-pure water, or gases is ideal. Here, the terms high-purity or ultra-pure water are understood to mean water that corresponds to the standards of ASTM D1193-99E1, Type I (chemical impurities) and/or Type A (microbiological contamination) and ASTM D5127-99 Type E1, E1.1 and E1.2. Here, the liquid or the gas flows through the at least one channel between the cooling tube and the emitter tube and is heated by the at least one radiation source. The flow of fluids in the cooling tube here should preferably be turbulent at high outputs of the IR emitter employed, in order to guarantee sufficient heat transport from the emitter tube by convection and to prevent boiling of the fluid at the emitter tube. The infrared emitter element requires no additional cooling besides the fluid to be heated. Therefore, the construction of the through-flow heater is compact, it can be manufactured with low production expense, and it exhibits extremely low susceptibility to failures. At the same time, however, such a through-flow heater has a high efficiency and a high output and is easy to maintain or exchange due to its simple construction.

The high-purity liquid or gas to be heated is guided through the through-flow heater exclusively in contact with the cooling tube made of silica glass and with the emitter tube made of silica glass. It is known that contact between silica glass and liquids or gases leads only to an extremely low contamination of the liquid or the gas. Contact with plastics or even metals, which contaminate the fluid considerably more strongly, is prevented.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 1 is a longitudinal section through a first embodiment of an infrared emitter element with two emitter tubes (twin tube) inside the cooling tube;

FIG. 2 is a longitudinal section of a second embodiment of an infrared emitter element with two emitter tubes (twin tube) in the cooling tube;

FIG. 3 is a longitudinal section of a third embodiment of an infrared emitter element with one emitter tube in the cooling tube;

FIG. 3A is a longitudinal section of a fourth embodiment of an infrared emitter element similar to FIG. 3, but with flow baffles and a protective layer;

FIG. 4 is a graph plotting the penetration depth X of radiation into water at different wavelengths $\lambda$;

FIG. 5 is a graph plotting the emitted power $L_n$ (normalized to the total emission output) of an electrical conductor made of tungsten wire as a function of the wavelength $\lambda$;

FIG. 6 is a graph plotting the radiation absorbed $V_{SR}$ in the emitter tube as a function of the temperature $T_{eL}$ of an electrical conductor made of tungsten wire; and FIG. 7 is a graph plotting the temperature change of water $\Delta T_{H2O}$ as a function of the rate of flow Q through a through-flow heater according to the invention.

Throughout the drawings like or similar elements are designated by the same reference numeral.

DETAILED DESCRIPTION OF THE INVENTION

Figure 1:
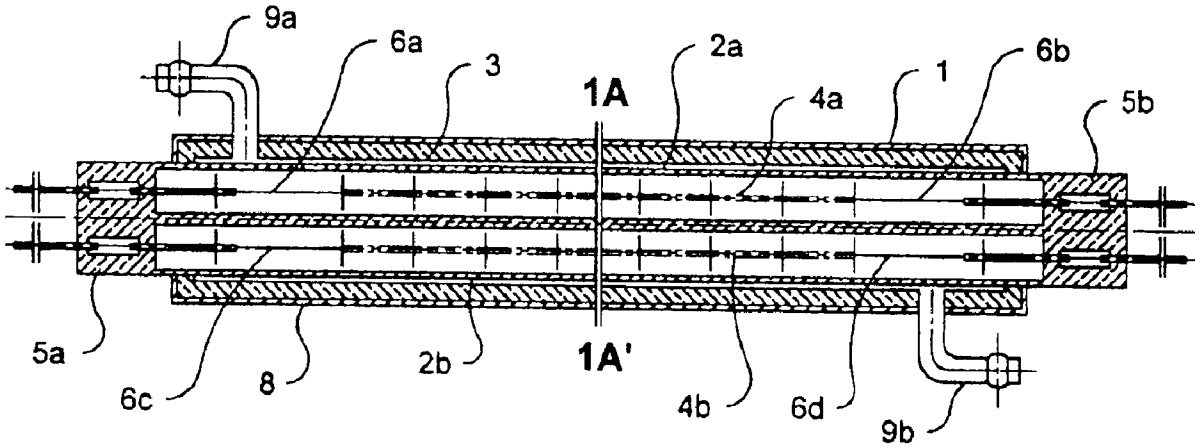
FIGS. 1–3A illustrate embodiments of the infrared emitter element according to the invention.

FIG. 1 shows the longitudinal section of an infrared emitter element 1 with two emitter tubes 2*a*, 2*b* or a twin tube in the cooling tube 3. Both of the emitter tubes 2*a*, 2*b* and also the cooling tube 3 are formed of silica glass. Electrical conductors 4*a*, 4*b* in the form of tungsten coils are arranged in the emitter tubes 2*a*, 2*b*. The electrical conductors 4*a*, 4*b* are connected electrically by connection wires 6*a*, 6*b*, 6*c*, 6*d*, wherein the connection wires 6*a*, 6*b*, 6*c*, 6*d* are led gas-tight through the emitter tubes 2*a*, 2*b* via current bushings 5*a*, 5*b*. The cooling tube has a cooling channel 3*a* (see FIG. 1A), which surrounds the emitter tubes 2*a*, 2*b*. Furthermore, connection ports 9*a*, 9*b* made of silica glass are present on the cooling tube 3, which enable the supply and discharge of a fluid into and out of the cooling channel 3*a*. On the surface of the cooling tube 3 facing away from the cooling channel 3*a*, there is a reflector layer 8 made of gold.

Figure 1A:
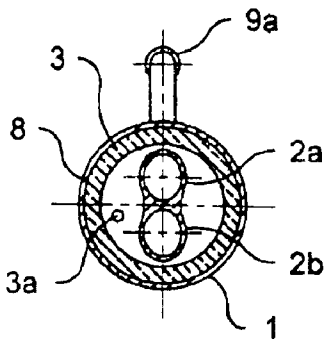
FIG. 1A is a transverse cross section 1A–1A' through the infrared emitter element from FIG. 1.

FIG. 1A shows the cross section 1A–1A' of the infrared emitter element from FIG. 1, especially the arrangement of the cooling channel 3*a*.

In a preferred embodiment, an electrical output of 6 kW is applied by the infrared emitter element according to FIGS. 1 and 1A. This is generated by two electrical conductors arranged in a twin tube and formed from tungsten coils, which operate at an emission temperature of about 2600° K. The efficiency (expended electrical output to heating output) of such an arrangement is high at >95%, according to which there are only a few regions in which power losses can occur. The full output of the infrared emitter element is reached according to though-flow within 10 seconds up to 2 min. The full output of the radiation source is reached after 1 to 2 seconds.

Figure 2A:
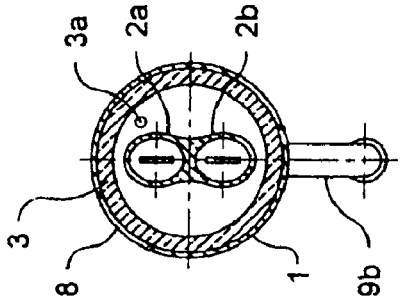
FIG. 2A is a transverse cross section 2A–2A' through the infrared emitter element from FIG. 2.
Figure 2:
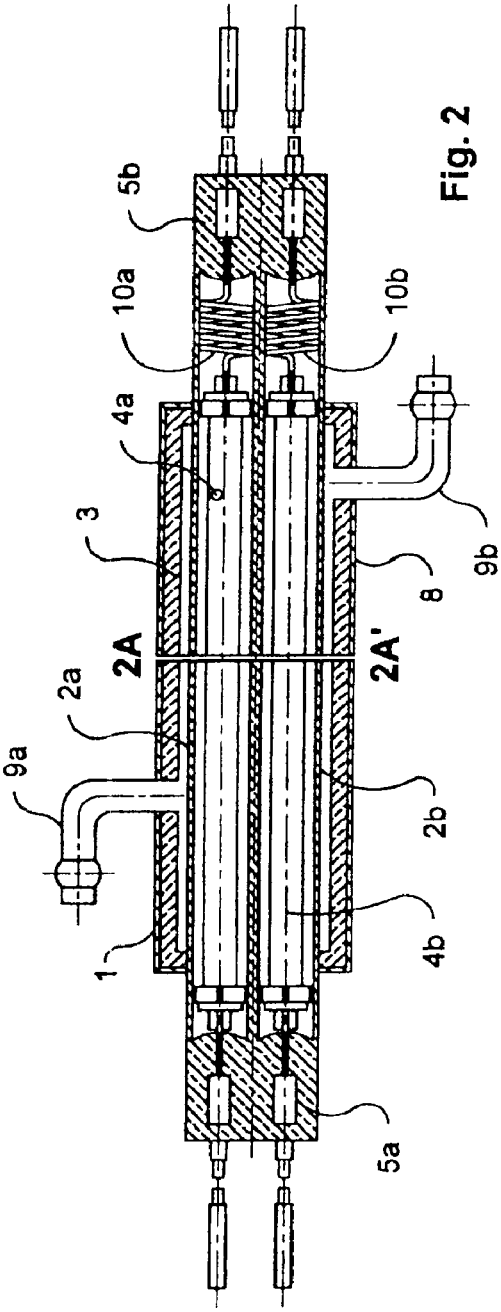

FIG. 2 shows the longitudinal section of another embodiment of an infrared emitter element 1 with two emitter tubes 2*a*, 2*b* or a twin tube in the cooling tube 3. Both of the emitter tubes 2*a*, 2*b* and the cooling tube 3 are formed of silica glass. Electrical conductors 4*a*, 4*b* in the form of carbon bands are arranged in the emitter tubes 2*a*, 2*b*. The electrical conductors 4*a*, 4*b* are tensioned by springs 10*a*, 10*b*, and the electrical connection is led gas-tight through the emitter tubes 2*a*, 2*b* to the outside via the current bushings 5*a*, 5*b*. The cooling tube 3 has a cooling channel 3*a* (see FIG. 2A), which surrounds the emitter tubes 2*a*, 2*b*. Furthermore, on the cooling tube 3 there are connection ports 9*a*, 9*b* made of silica glass, which enable the supply and discharge of a fluid into and out of the cooling channel 3*a*. A reflector layer 8 made of gold is arranged on the surface of the cooling tube 3 facing away from the cooling channel 3*a*.

FIG. 2A shows the cross section 2A–2A' of the infrared emitter element 1 from FIG. 2, particularly the arrangement of the cooling channel 3*a*.

Figure 3:
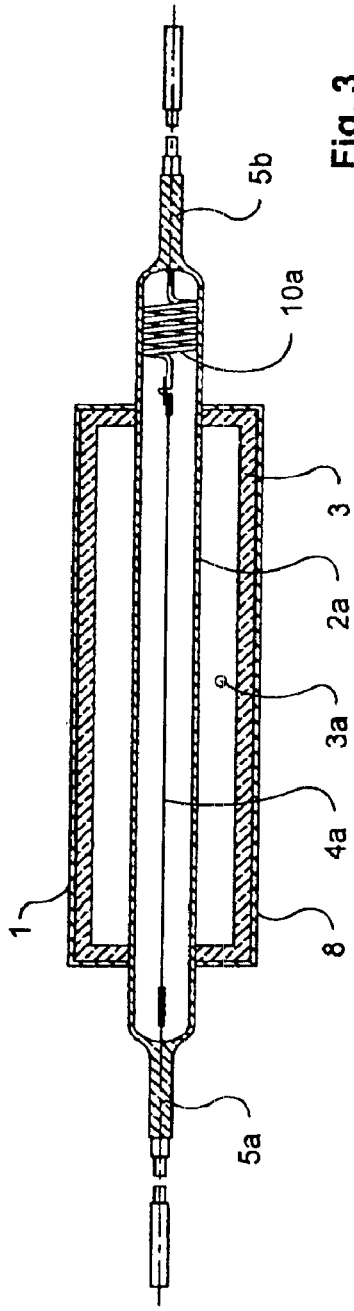

FIG. 3 shows the longitudinal section of a further embodiment of an infrared emitter element 1 with one emitter tube 2*a* in the cooling tube 3. Both the emitter tube 2*a* and the cooling tube 3 are formed of silica glass. An electrical conductor 4*a* in the form of a carbon band is arranged in the emitter tube 2*a*. The electrical conductor 4*a* is tensioned by a spring 10*a*, and the electrical connection is led gas-tight through the emitter tube 2*a* to the outside via the current bushings 5*a*, 5*b*. The cooling tube 3 has a cooling channel 3*a*, which surrounds the emitter tube 2*a*. Furthermore, on the cooling tube 3 there are connections ports (not shown) made of silica glass, which enable the supply and discharge of a fluid into and out of the cooling channel 3*a*. A reflector layer 8 made of gold is arranged on the surface of the cooling tube 3 facing away from the cooling channel 3*a*.

Figure 3A:
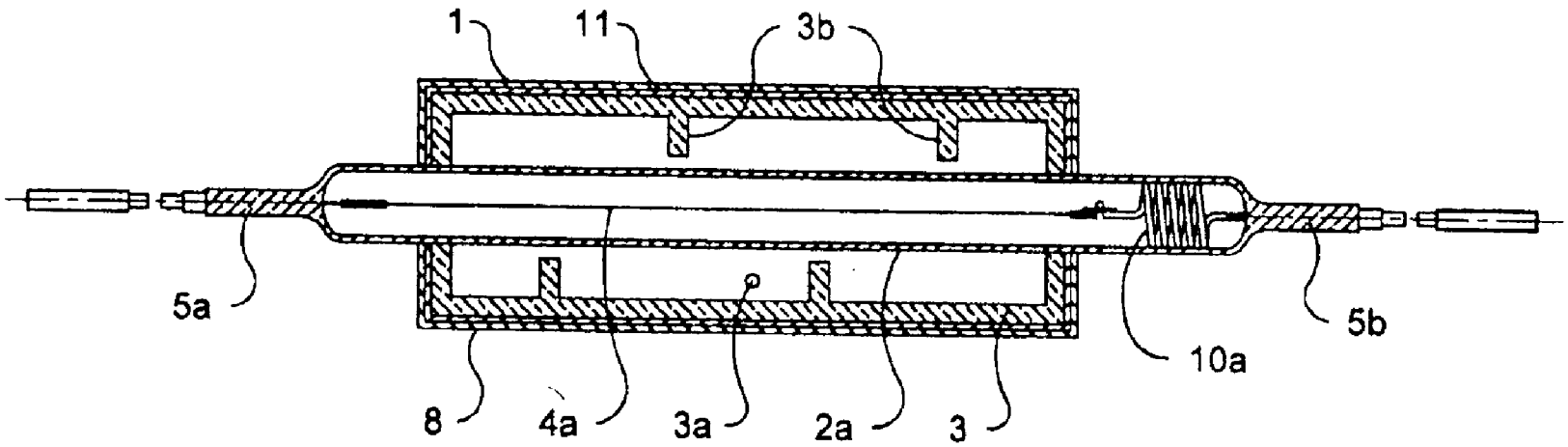

FIG. 3A shows the longitudinal section of another infrared emitter element, which is a variant of the embodiment of FIG. 3. In this embodiment baffle elements 3*b* extend into the cooling channel 3*a* from the interior walls of the cooling tube 3, in order to influence the flow of the fluid in the channel, i.e., here to produce turbulent flow in the cooling tube. The baffle elements 3*b* are preferably made of silica glass. Further, the reflector layer is provided on its outer side (facing away from the cooling tube) with a scratch-resistant protective layer 11.

Additional configurations of the infrared emitter element according to the invention are possible and can be easily discovered in non-inventive ways, for example, by a separate arrangement of several emitter tubes in the cooling channel or by the arrangement of elements for influencing the flow in the cooling channel.

Figure 4:
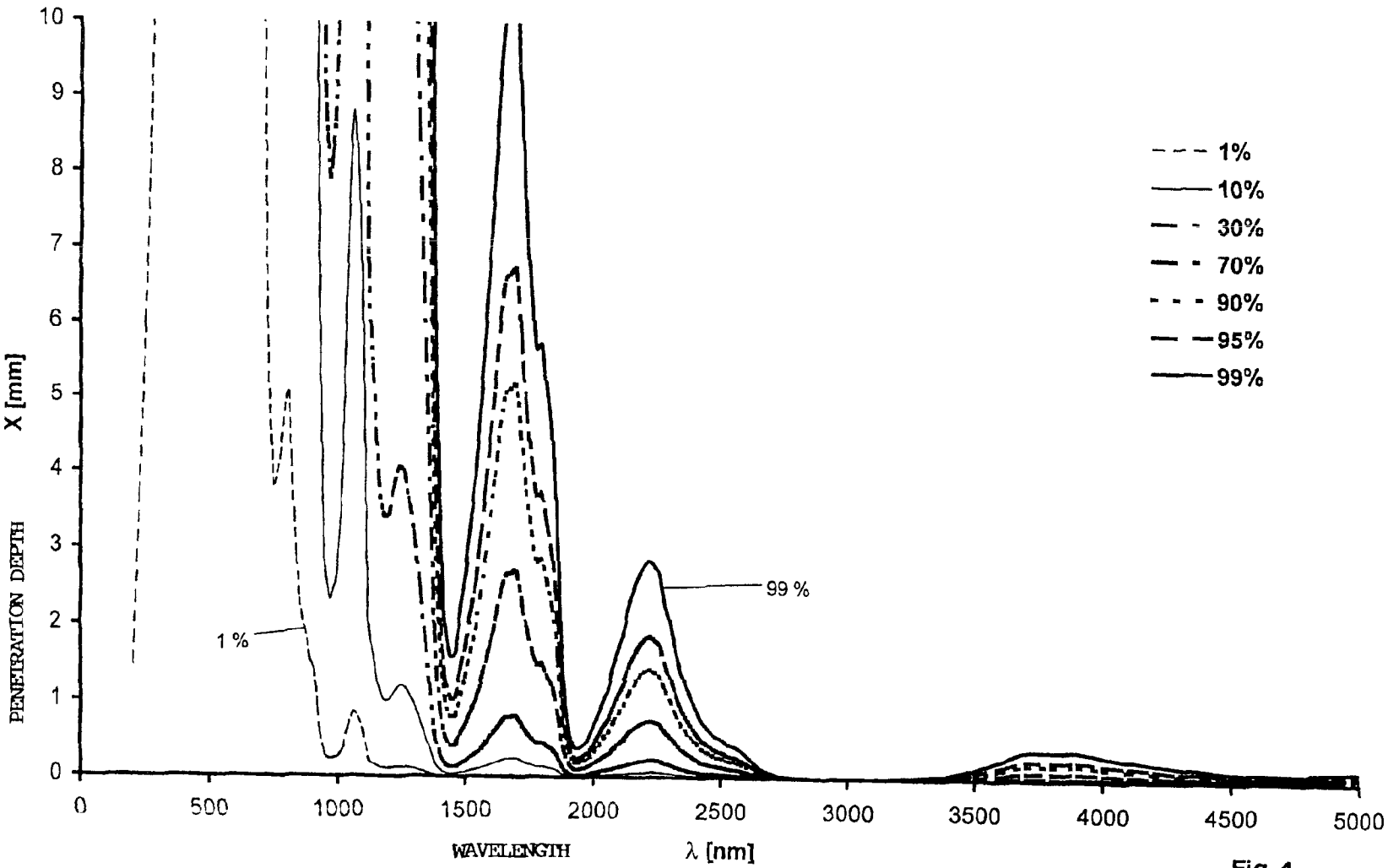
FIGS. 4–7 show graphs of performed measurements. In particular.

FIG. 4 shows a graph, in which the penetration depth X of the radiation into the water is shown as a function of the wavelength λ of the radiation. Here, the curves show the percentage portions of the radiation absorbed in the water. For water layers with a thickness of a few millimeters, it can be seen that in terms of a uniform through heating, wavelengths in the range of about 1300 to 1800 nm are to be preferred. In contrast, for water layers with a thickness of a few centimeters, wavelengths in the range of about 900 to 1400 nm are advantageous.

Figure 5:
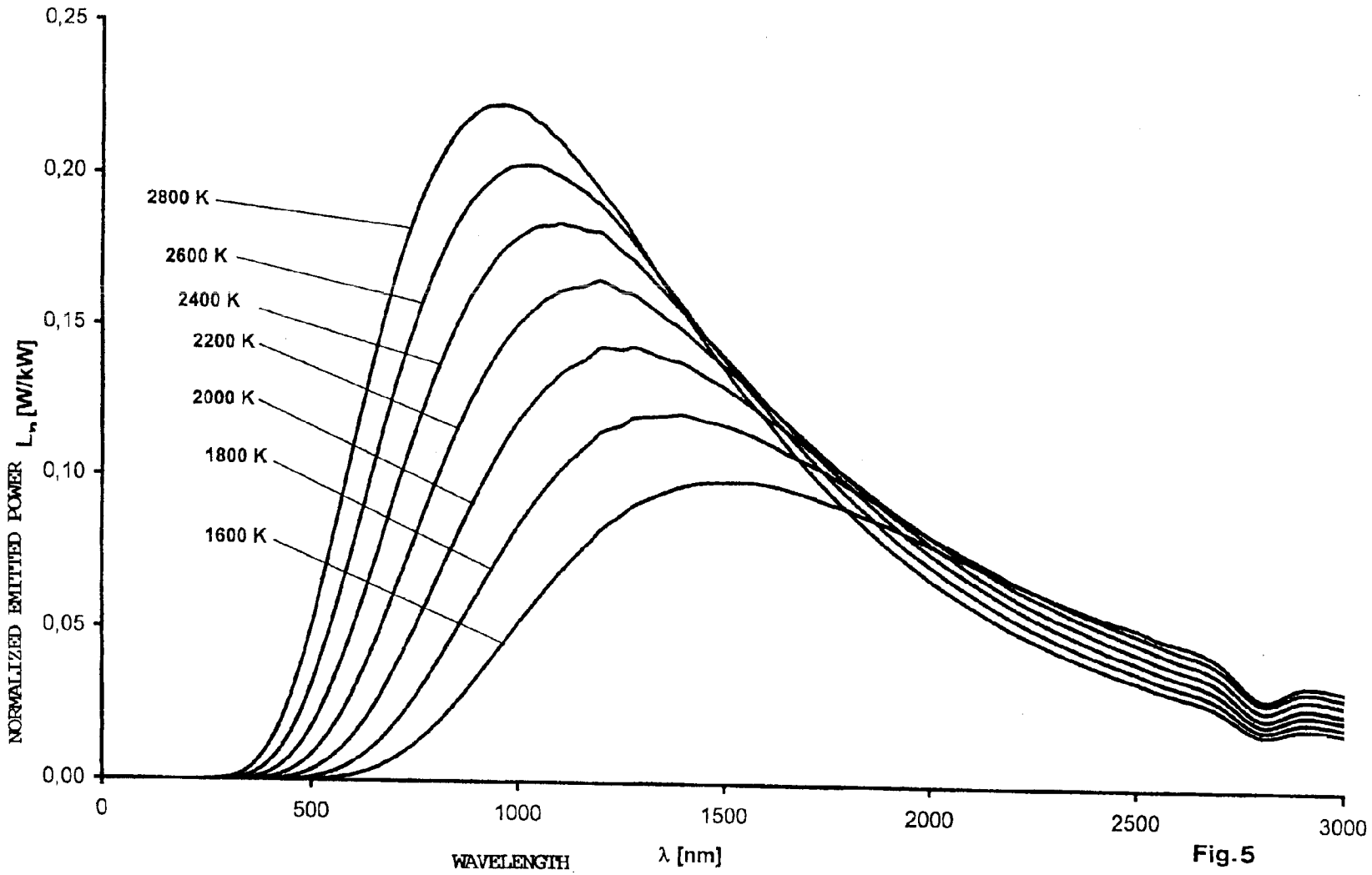

FIG. 5 shows the emitted power $L_n$ of an electrical conductor made of tungsten wire in an approximately 2 mm thick silica glass tube as a function of the wavelength λ, normalized to the total output. The illustrated curves indicate the temperature of the electrical conductor. It can be seen that for low temperatures of the electrical conductor in the range of about 1600 to 2200° K, a rather broadband, medium-wavelength spectrum is achieved. Such spectra achieve sufficient penetration depths into water only with their short-wavelength fraction. At temperatures of the electrical conductor in the range of about 2600 to 2800° K, the fraction of the radiation that must traverse very long distances in water in order to be absorbed dominates. Thus, for the electrical conductor made of tungsten temperatures in the range of about 2400 to 2600° K are preferred.

Figure 6:
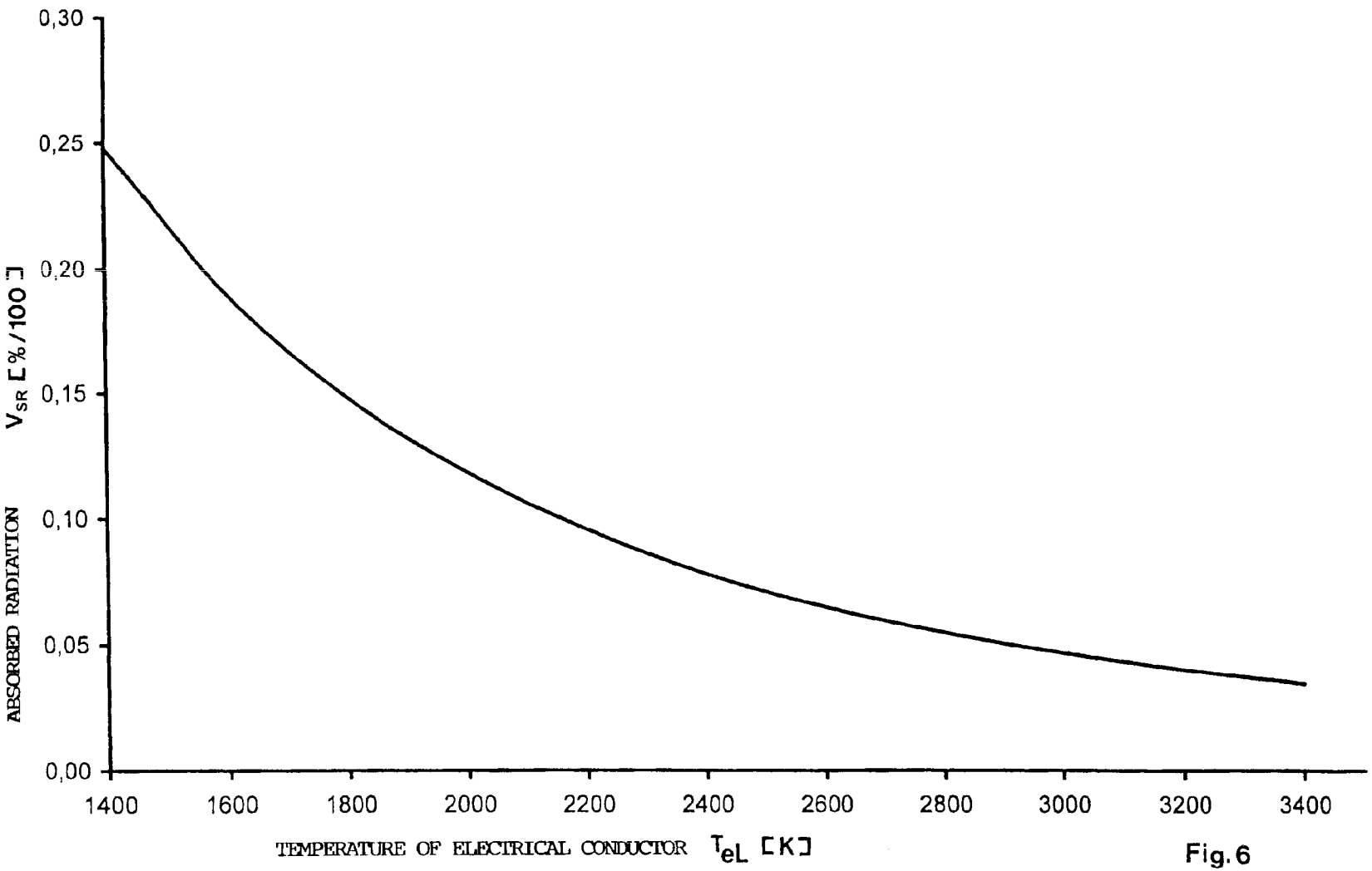

However, FIG. 6 shows that, in principle, the use of an electrical conductor with the highest possible temperature is desirable. The fraction $V_{SR}$ of the radiation absorbed in the emitter tube is here shown as a function of the temperature $T_{el}$ of an electrical conductor made of tungsten wire. It can be seen that with rising temperature of the electrical conductor, the loss of radiation absorbed in the emitter tube made of silica glass decreases.

Figure 7:
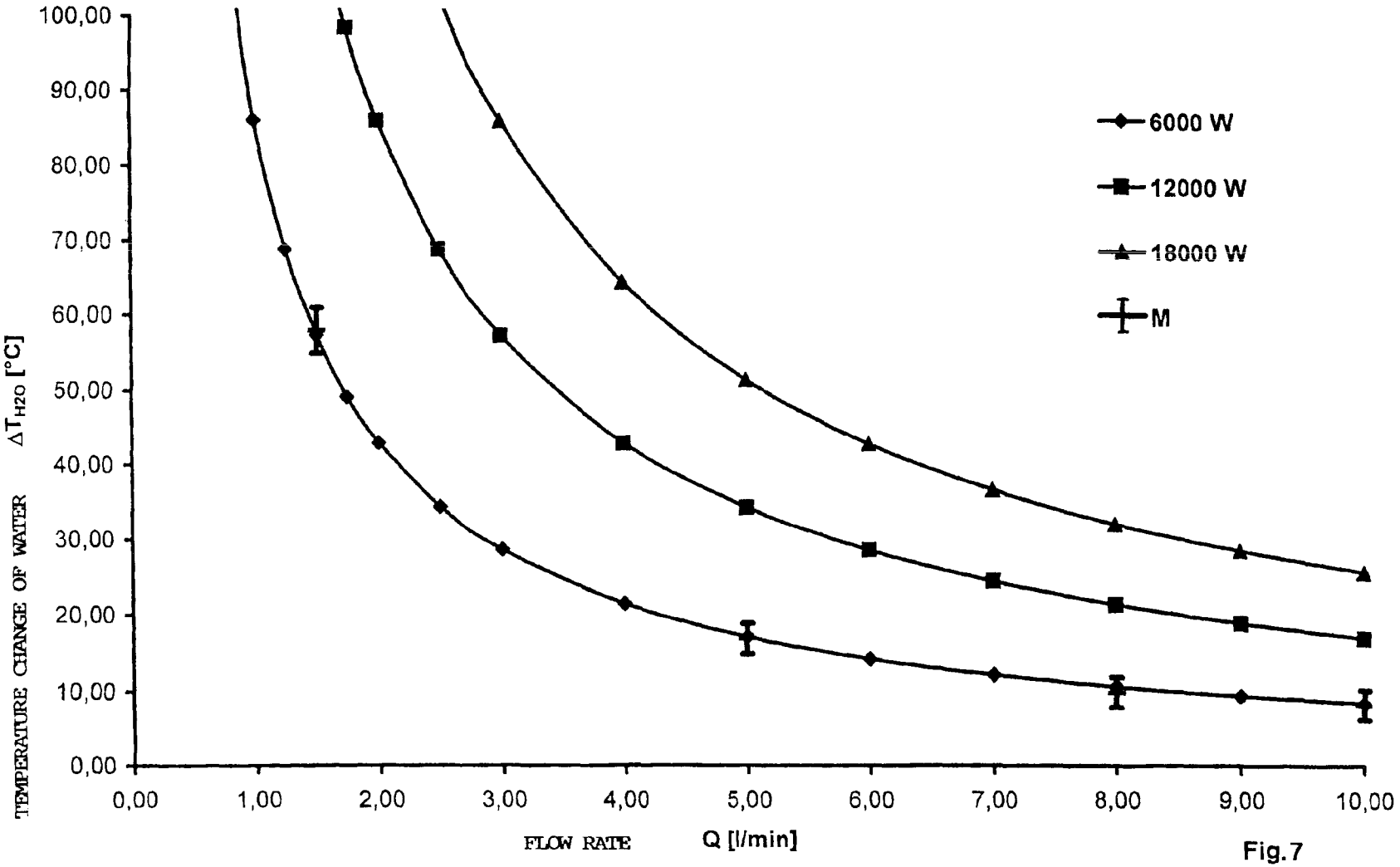

FIG. 7 shows the temperature change $\Delta T_{H2O}$ of water with an input temperature of 20° C. as a function of the rate of flow Q through a through-flow heater according to the invention, wherein emitter outputs were selected in the range of 6000 W, 12,000 W, and 18,000 W. The measurement points M show measured values for an emitter output of 6000 W, which verify the accuracy of the theoretical curves.

A further temperature increase of the water can be achieved either by a long dwell period of the fluid to be heated in the through-flow heater according to the invention or by a series circuit of several through-flow heaters according to the invention. Caution should be taken with a parallel operation of through-flow heaters, because here the flow rate can be decreased so much that there is the risk of heating the water too strongly, which could lead to bubble formation.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An infrared emitter element comprising:

at least one emitter tube (2*a*, 2*b*) comprising silica glass, the emitter tube having two ends;

at least one electrical conductor (4*a*, 4*b*) arranged in the emitter tube as a radiation source;

a cooling tube (3) comprising silica glass, the cooling tube surrounding the at least one emitter tube spaced therefrom and being connected to the at least one emitter tube directly at its ends, such that in a region of the at least one electrical conductor at least one flow-supporting channel (3*a*) is formed between the at least one emitter tube and the cooling tube; and a metallic reflector (8), wherein the cooling tube (3) is completely covered with the reflector (8) on its side facing away from the emitter tube (2*a*, 2*b*).

2. The infrared emitter element according to claim 1, wherein the emitter tube (2*a*, 2*b*) is closed gas-tight on its two ends, and wherein a gas-tight current bushing (5*a*, 5*b*) is arranged on at least one of the two ends.

3. The infrared emitter element according to claim 1, wherein the cooling tube (3) is arranged coaxial to the at least one emitter tube (2*a*, 2*b*).

4. The infrared emitter element according to claim 1, wherein the cooling tube (3) has on its one end an inlet port (9*a*) and on its other end an outlet port (9*b*).

5. The infrared emitter element according to claim 1, wherein the reflector (8) comprises a gold layer.

6. The infrared emitter element according to claim 5, wherein the gold layer is fired onto the cooling tube (3).

7. The infrared emitter element according to claim 5, wherein the reflector (8) is covered with a protective layer (11) on its side facing away from the cooling tube (3).

8. The infrared emitter element according to claim 1, further comprising elements made of silica glass arranged in the at least one channel (3*a*) for influencing flow.

9. The infrared emitter element according to claim 1, wherein the at least one channel (3*a*) has an at least approximately circular ring-shaped cross section.

10. The infrared emitter element according to claim 1, wherein the at least one channel (3*a*) runs in spiral form along the at least one emitter tube (2*a*, 2*b*).

11. The infrared emitter element according to claim 1, wherein the electrical conductor (4*a*, 4*b*) comprises tungsten.

12. The infrared emitter element according to claim 1, wherein the electrical conductor (4*a*, 4*b*) comprises NiCr or AlCrFe.

13. The infrared emitter element according to claim 1, wherein the electrical conductor (4*a*, 4*b*) comprises a carbon material.

14. The infrared emitter element according to claim 1, in a form of a through-flow heater for a liquid or a gas, wherein the liquid or gas flows through the at least one channel (3*a*) between the cooling tube (3) and the at least one emitter tube (2*a*, 2*b*) and is heated by the at least one radiation source.

15. The infrared emitter element according to claim 14, wherein the liquid is high-purity water according to ASTM D1193-99e1, Type I and ASTM D5127-99 Type E1, E1.1 and E1.2.

16. The infrared emitter element according to claims 14, wherein the liquid is high-purity water according to ASTM D1193-99e1, Type A and ASTM D5127-99 Type E1, E1.1and E1.2.

* * * * *